US008881688B2

(12) United States Patent
English et al.

(10) Patent No.: US 8,881,688 B2
(45) Date of Patent: Nov. 11, 2014

(54) GAS-FIRED WATER HEATER WITH AN EXHAUST ASSEMBLY

(75) Inventors: Stephen T. English, Englewood, OH (US); Michael R. Hasbargen, Troy, OH (US); Anthony J. Coloma, Troy, OH (US); John R. Belko, Tipp City, OH (US); Stephanie Marie Belko, legal representative, Tipp City, OH (US)

(73) Assignee: A. O. Smith Corporation, Milwaukee, WI (US)

( * ) Notice: Subject to any disclaimer, the term of this patent is extended or adjusted under 35 U.S.C. 154(b) by 841 days.

(21) Appl. No.: 13/006,158

(22) Filed: Jan. 13, 2011

(65) Prior Publication Data

US 2012/0180737 A1 Jul. 19, 2012

(51) Int. Cl.

| | |
|---|---|
| ***F24H 7/00*** | (2006.01) |
| ***F24H 9/00*** | (2006.01) |
| ***F23L 17/00*** | (2006.01) |
| ***F24H 1/20*** | (2006.01) |

(52) U.S. Cl.

CPC ..... *F24H 9/0031* (2013.01); *F23L 17/005* (2013.01); *F24H 1/205* (2013.01)

USPC ..... 122/18.31; 122/312

(58) Field of Classification Search

USPC ..... 122/18.31, 312

See application file for complete search history.

(56) References Cited

U.S. PATENT DOCUMENTS

| | | | | |
|---|---|---|---|---|
| 2,349,668 | A | 5/1944 | Marker et al. | |
| 2,710,573 | A | 6/1955 | Marker | |
| 3,407,993 | A * | 10/1968 | Bostrom | 415/127 |
| 4,672,919 | A | 6/1987 | Staats | |
| 4,856,982 | A | 8/1989 | Olson | |
| 5,197,665 | A | 3/1993 | Jenson et al. | |
| 5,255,665 | A | 10/1993 | Windon | |
| 5,352,099 | A | 10/1994 | Anstine et al. | |
| 5,950,573 | A | 9/1999 | Shellenberger et al. | |
| 6,053,130 | A | 4/2000 | Shellenberger | |
| D439,648 | S * | 3/2001 | Jones et al. | D23/370 |
| 6,398,512 | B2 | 6/2002 | Stewart | |
| 6,602,058 | B1 | 8/2003 | Stewart et al. | |
| 6,622,660 | B1 | 9/2003 | Bajic et al. | |
| D491,259 | S | 6/2004 | Garrison et al. | |
| 6,745,724 | B2 | 6/2004 | Hughes et al. | |
| 6,827,560 | B2 | 12/2004 | Gatley, Jr. et al. | |
| 7,159,540 | B2 | 1/2007 | Garrabrant et al. | |
| 7,354,244 | B2 | 4/2008 | Hasbargen et al. | |
| 7,363,882 | B2 | 4/2008 | Brown et al. | |
| 2002/0178980 | A1 * | 12/2002 | Gatley, Jr. | 110/182.5 |

(Continued)

*Primary Examiner* — Kang Hu
*Assistant Examiner* — John Bargero
(74) *Attorney, Agent, or Firm* — Michael Best & Friedrich LLP

(57) ABSTRACT

An exhaust assembly for use with a gas-fired water heater that includes a hood for receiving exhaust gas from the gas-fired water heater, a housing, and a fan positioned in the housing to move exhaust gas from the hood out of the exhaust outlet. The hood includes a first hood mounting location and a second hood mounting location. The housing includes an exhaust outlet and a housing mounting location. In a first configuration, the exhaust outlet faces a first direction and the housing mounting location is aligned with and secured at the first hood mounting location. In a second configuration, the exhaust outlet faces a second direction different than the first direction and the housing mounting location is aligned with and secured at the second hood mounting location.

12 Claims, 14 Drawing Sheets

(56) References Cited

U.S. PATENT DOCUMENTS

| | | | | |
|---|---|---|---|---|
| 2004/0258546 | A1 | 12/2004 | Gatley, Jr. | |
| 2005/0058560 | A1 | 3/2005 | Gatley, Jr. et al. | |
| 2006/0065211 | A1 | 3/2006 | Hasbargen et al. | |
| 2006/0099072 | A1* | 5/2006 | Lyons | 415/214.1 |
| 2006/0191497 | A1 | 8/2006 | Garrabrant et al. | |
| 2006/0213912 | A1* | 9/2006 | Zaytoun | 220/293 |
| 2009/0084328 | A1 | 4/2009 | Lyons et al. | |
| 2009/0211540 | A1 | 8/2009 | Yin et al. | |

* cited by examiner

GAS-FIRED WATER HEATER WITH AN EXHAUST ASSEMBLY

BACKGROUND

The present invention relates to water heaters, and more particularly to gas-fired water heaters with exhaust assemblies.

Typical gas-fired water heaters produce exhaust gases or products of combustion that must be exhausted outside of the residence or other building in which the water heater is installed. An exhaust assembly, blower, or fan moves the exhaust gases generated by the water heater from the water heater to the atmosphere outside the building.

SUMMARY

The present invention provides, in one aspect, an exhaust assembly for use with a gas-fired water heater. The exhaust assembly includes a hood for receiving exhaust gas from the gas-fired water heater, a housing, and a fan positioned in the housing to move exhaust gas from the hood out of the exhaust outlet. The hood includes a first hood mounting location and a second hood mounting location. The housing includes an exhaust outlet and a housing mounting location. In a first configuration, the exhaust outlet faces a first direction and the housing mounting location is aligned with and secured at the first hood mounting location. In a second configuration, the exhaust outlet faces a second direction different than the first direction and the housing mounting location is aligned with and secured at the second hood mounting location.

The present invention provides, in another aspect, an exhaust assembly for use with a gas-fired water heater. The exhaust assembly includes a hood for receiving exhaust gas from the gas-fired water heater, a back plate coupled to the hood, a housing, multiple tabs, and a fan positioned in the housing to move exhaust gas from the hood out of the exhaust outlet. The hood includes a first hood mounting location and a second hood mounting location. The back plate includes a rearwardly extending cylindrical rim with a locking groove formed in the outer surface of the rim. The housing includes an exhaust outlet, a housing mounting location, and a cylindrical collar with multiple slots through the collar. The rim is positioned within the collar. Each of the tabs is coupled to the housing and extends through a corresponding slot and into the locking groove, thereby rotatably coupling the housing to the hood. In a first configuration, the exhaust outlet faces a first direction and the housing mounting location is aligned with and secured at the first hood mounting location. In a second configuration, the exhaust outlet faces a second direction different than the first direction and the housing mounting location is aligned with and secured at the second hood mounting location.

The present invention provides, in another aspect, a gas-fired water heater. The gas-fired water heater includes a storage tank, a combustion chamber, a burner for producing products of combustion, the burner positioned in the combustion chamber, a flue extending from the combustion chamber through the storage tank, and an exhaust assembly positioned above the flue. The exhaust assembly includes a hood for receiving the products of combustion from the gas-fired water heater, a housing, and a fan positioned in the housing to move the products of combustion from the hood out of the exhaust outlet. The hood includes a first hood mounting location and a second hood mounting location. The housing includes an exhaust outlet and a housing mounting location. In a first configuration, the exhaust outlet faces a first direction and the housing mounting location is aligned with and secured at the first hood mounting location. In a second configuration, the exhaust outlet faces a second direction different than the first direction and the housing mounting location is aligned with and secured at the second hood mounting location.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
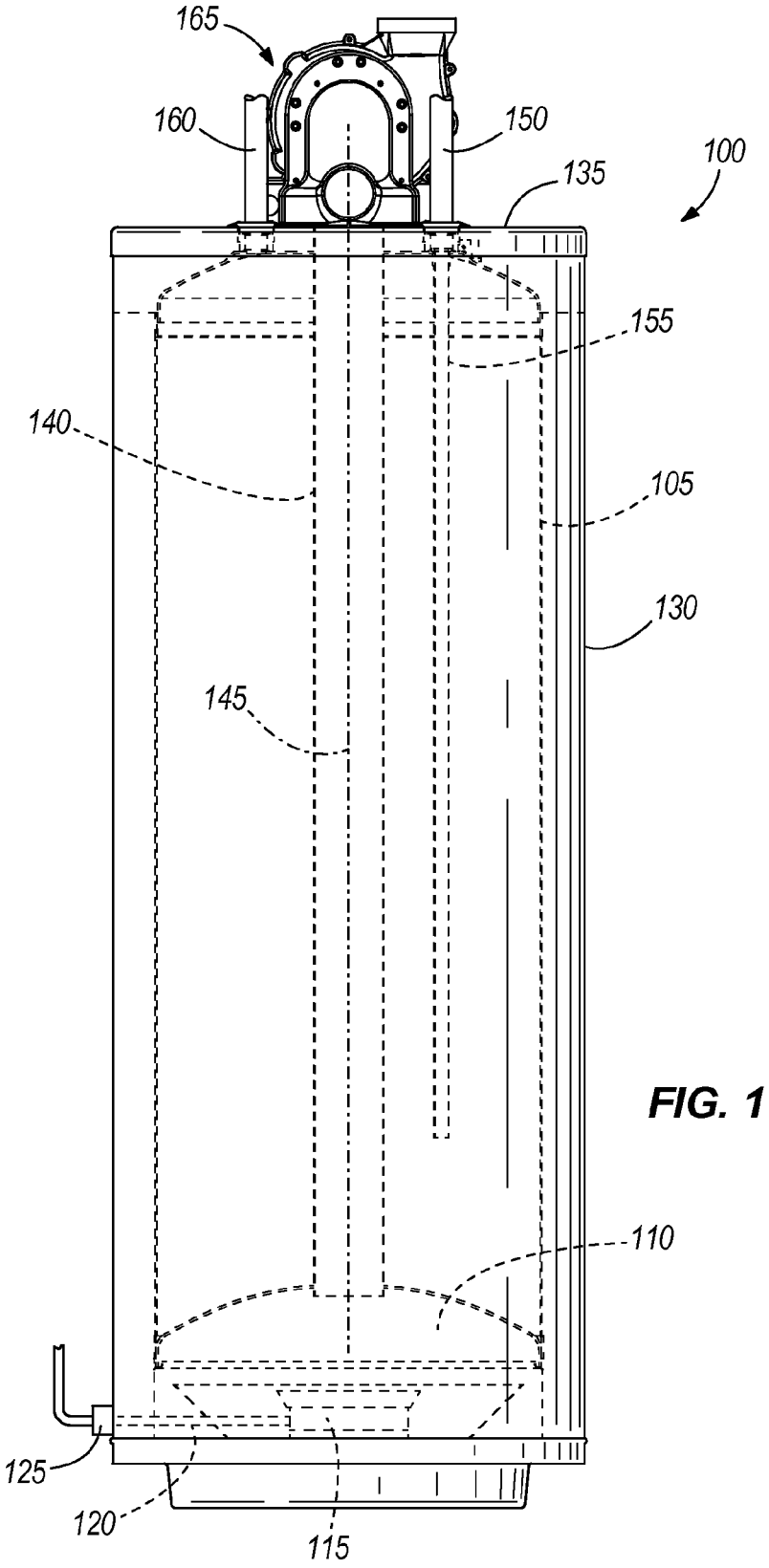
FIG. 1 is a front view of a water heater including an exhaust assembly.

FIG. 1 illustrates a gas-fired water heater 100. The water heater 100 includes a water storage tank 105 and a combustion chamber 110 positioned below the storage tank 105. A gas burner 115 is positioned in the combustion chamber 110. A flammable gas is provided to the gas burner 115 by a gas inlet or manifold 120 connected to a gas valve 125. The gas valve 125 is also connected to a gas supply. The combustion chamber 110 communicates with an air supply, for example, the atmosphere around the water heater 100. A jacket 130 including a cover 135 surrounds the storage tank 105 and combustion chamber 110. Foam insulation is provided between the storage tank 105 and jacket 130. A flue 140 extends from the combustion chamber 110, through the storage tank 105, and through the cover 135. The flue 140 includes a longitudinal axis 145. The products of combustion or exhaust gases created by the gas burner 115 flow through the flue 140 to heat the water stored in the storage tank 105. A cold water inlet pipe 150 is connected to a dip tube 155 to supply cold water to the storage tank 105. A hot water supply pipe 160 is connected to the storage tank 105 to supply hot water to an end-use location, for example, a faucet. An exhaust assembly 165 is coupled to the cover 135 and positioned above the flue 140. The exhaust assembly 165 receives the exhaust gas exiting the flue 140. The structure of the gas-fired water heater 100 other than the exhaust assembly 165 is typical of known gas-fired water heaters. The exhaust assembly 165 could also be used with other known gas-fired water heaters, including instantaneous or tankless water heaters or tank-tankless water heaters. Directional language refers to the exhaust assembly 165 as installed for normal, intended use with a gas-fired water heater 100.

Figure 2:
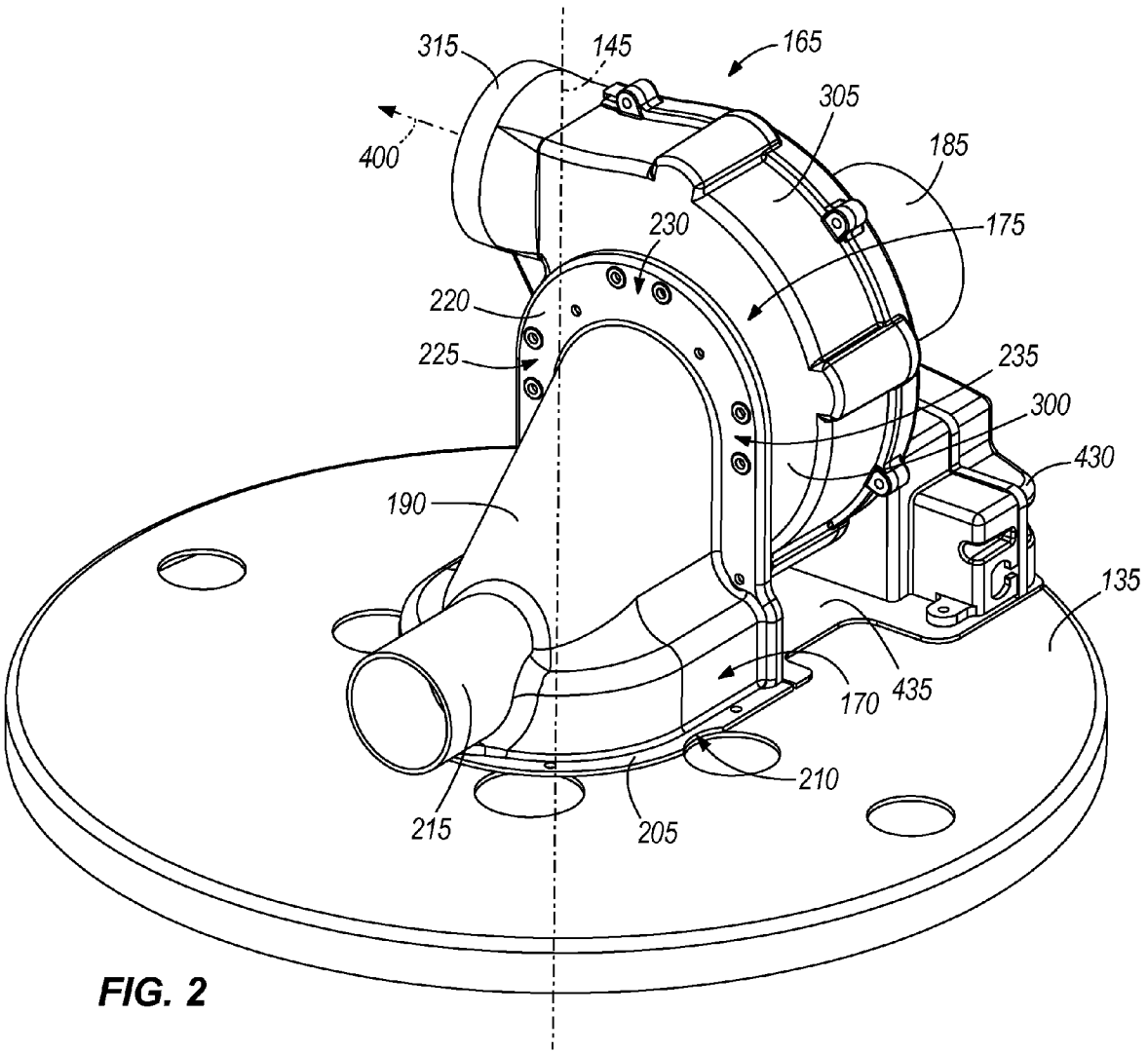
FIG. 2 is a perspective view of the exhaust assembly of FIG. 1 in a first configuration.
Figure 3:
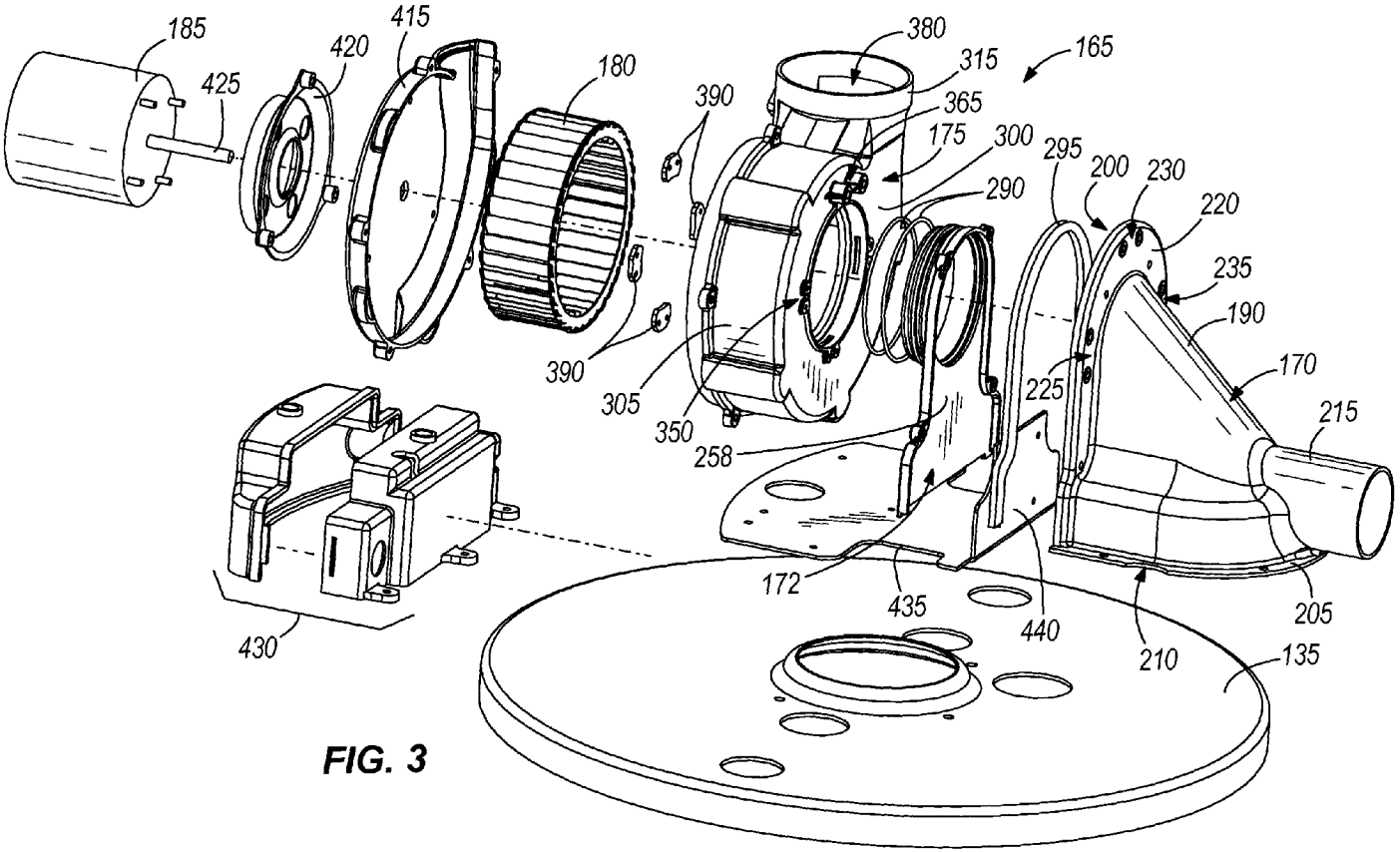
FIG. 3 is an exploded view of the exhaust assembly of FIG. 1.
Figure 4:
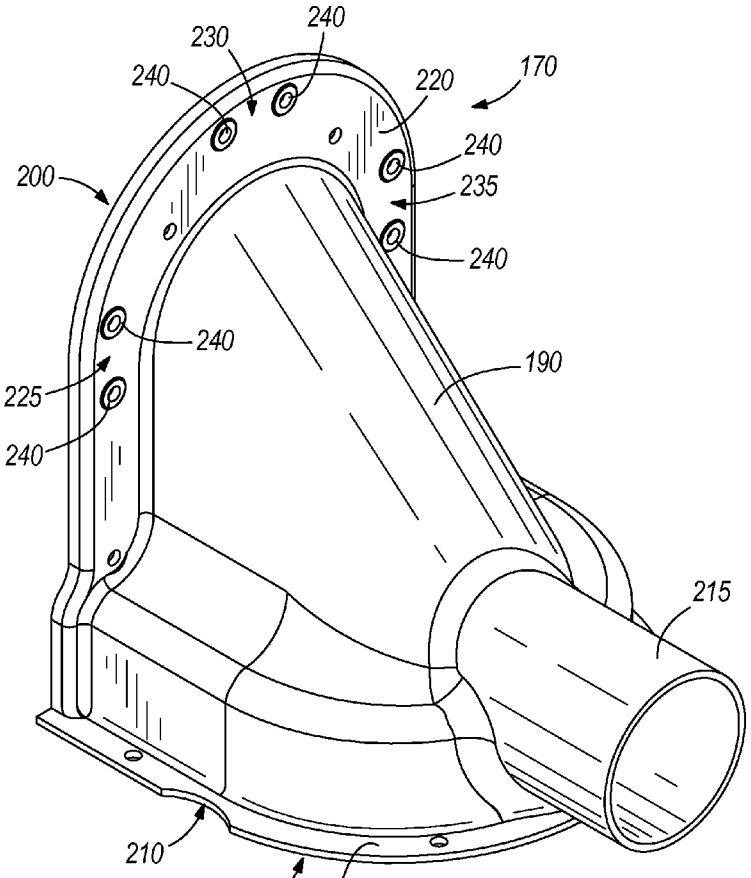
FIG. 4 is a perspective view of a hood of the exhaust assembly of FIG. 1.

As shown in FIGS. 2 and 3, the exhaust assembly 165 includes a hood 170, a back plate 172, a blower housing 175, a fan, blower, or impeller 180, and a motor 185. As shown in FIG. 4, the hood 170 includes a chamber 190 with an open bottom portion 195 and an open rear portion 200. The open bottom portion 195 is open to the flue 140 so the chamber 190 receives exhaust gas from the flue 140. A cover mounting flange 205 extends from the periphery of the bottom portion 195 for securing the hood 170 to the cover 135. The cover mounting flange 205 includes cut-outs or indentations 210 as necessary to accommodate the cold water inlet pipe 150 and the hot water supply pipe 160. The indentations 210 allow the hood 170 to be positioned between the cold water inlet pipe 150 and the hot water supply pipe 160. An air inlet 215 is connected to the chamber 190. Ambient dilution air is drawn through the air inlet 215 into the chamber 190. The dilution air mixes with the exhaust gas in the chamber 190, thereby reducing the concentration of undesirable chemicals formed during the combustion process and lowering the temperature of the exhaust gas before the mixture enters the blower housing 175. A housing mounting flange 220 extends from the periphery of the rear portion 200. The housing mounting flange 220 includes three hood mounting locations 225, 230, and 235. The first hood mounting location 225 is spaced ninety degrees from the second hood mounting location 230 and one hundred eighty degrees from the third hood mounting location 235. As shown, each hood mounting location 225, 230, and 235 includes a pair of apertures, holes, or openings 240 through the housing mounting flange 220.

Figure 5:
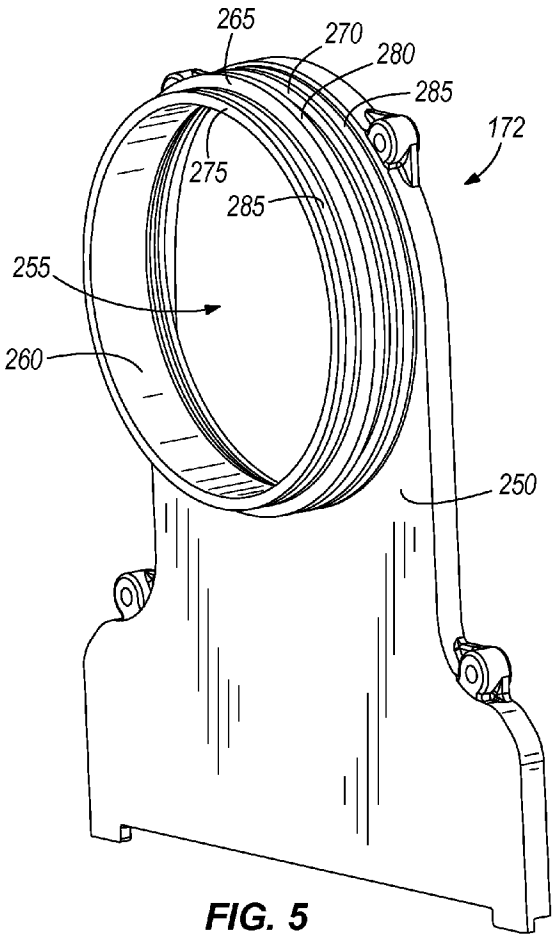
FIG. 5 is a perspective view of a back plate of the exhaust assembly of FIG. 1.
Figure 8:
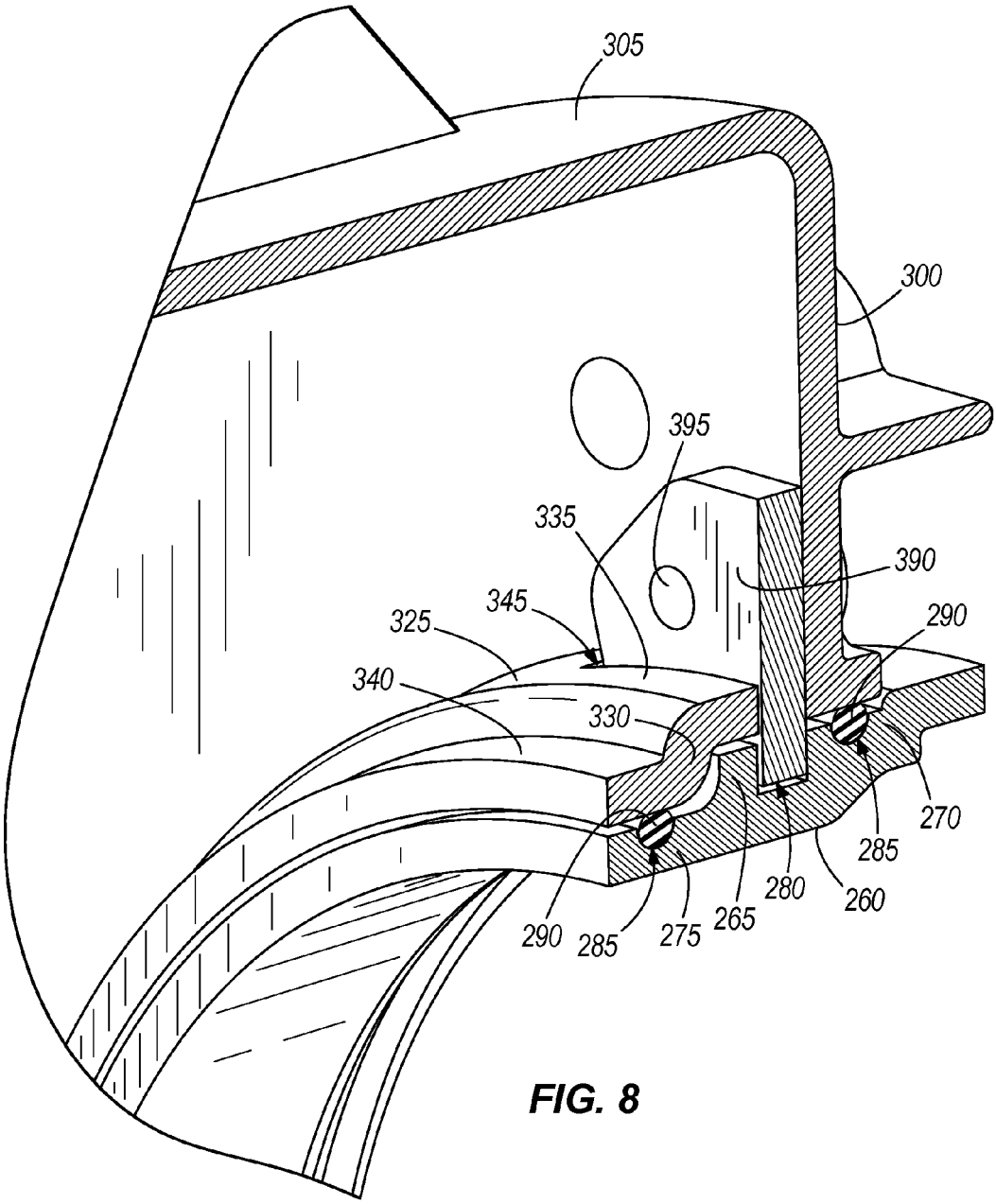
FIG. 8 is a section view through a portion of the exhaust assembly of FIG. 1.

As shown in FIG. 3, the back plate 172 is secured to the hood 170 to partially cover the open rear portion 200. As shown in FIG. 5, the back plate 172 includes a wall 250, a circular opening 255 through the wall 250, and a rim 260 surrounding the opening 255 and extending rearwardly from the wall 250. The rim 260 is cylindrical and coaxial with the opening 255. As best shown in FIG. 8, the rim 260 includes a protrusion 265 where the outer diameter of the rim 260 decreases from a wide portion 270 to a narrow portion 275. The rim 260 also includes a locking groove 280 formed in the outer surface of the rim 260 about the circumference of the rim 260. Additionally, two seal grooves 285 are formed in the outer surface of the rim 260 about the circumference of the rim 260. An o-ring or seal 290 is positioned in one or both of the seal grooves. The o-ring 290 is compressed between the back plate 172 and the blower housing 175 to provide a substantially air-tight seal between the back plate 172 and the blower housing 175. As shown in FIG. 3, a gasket or seal 295 is positioned between the back plate 172 and the hood 170. The gasket 295 is compressed between the back plate 172 and the hood 170 to provide a substantially air-tight seal between the back plate 172 and the hood 170. In some embodiments, the back plate 172 is an integral component of the hood 170.

Figure 6:
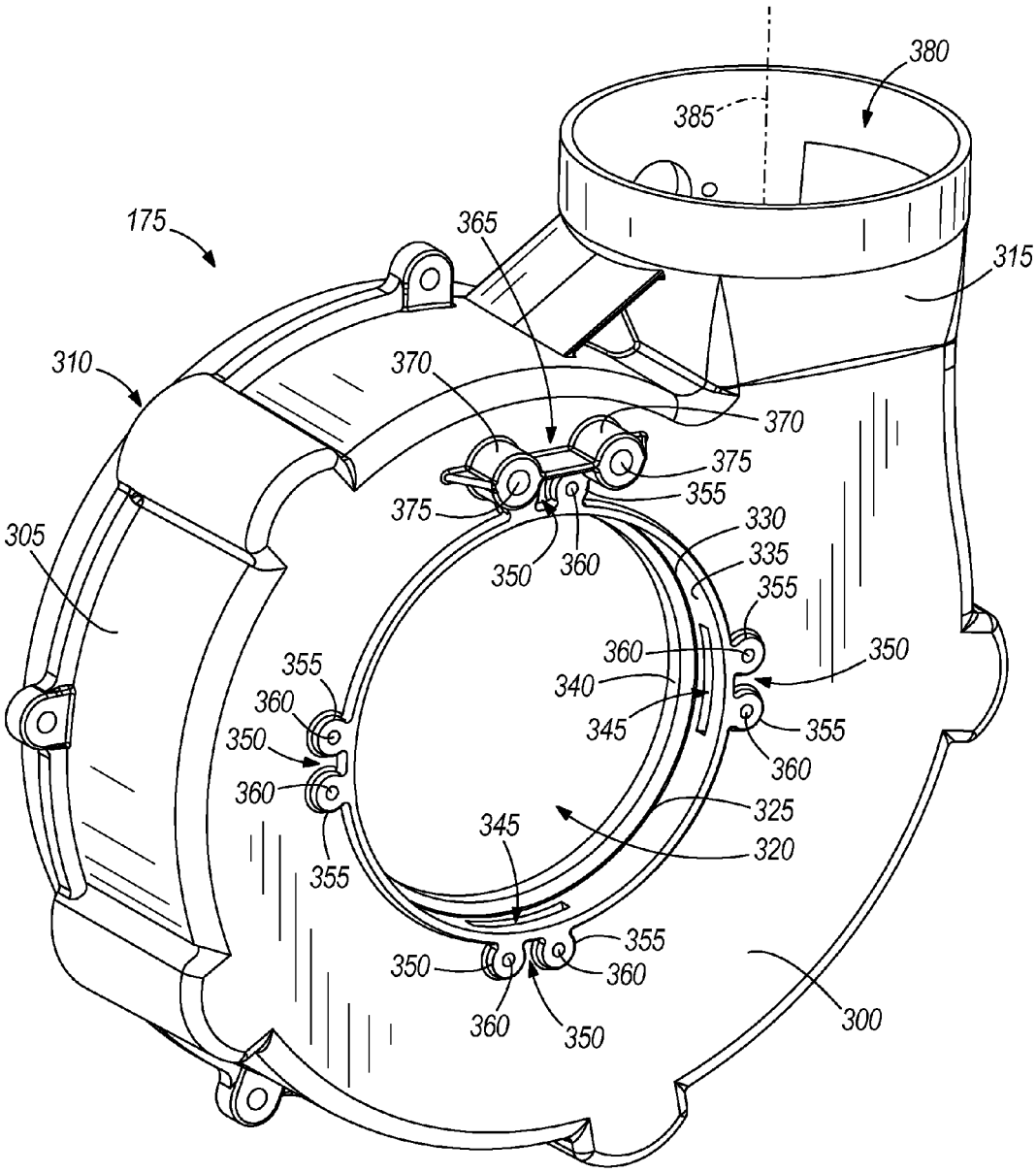
FIG. 6 is a front perspective view of a blower housing of the exhaust assembly of FIG. 1.
Figure 7:
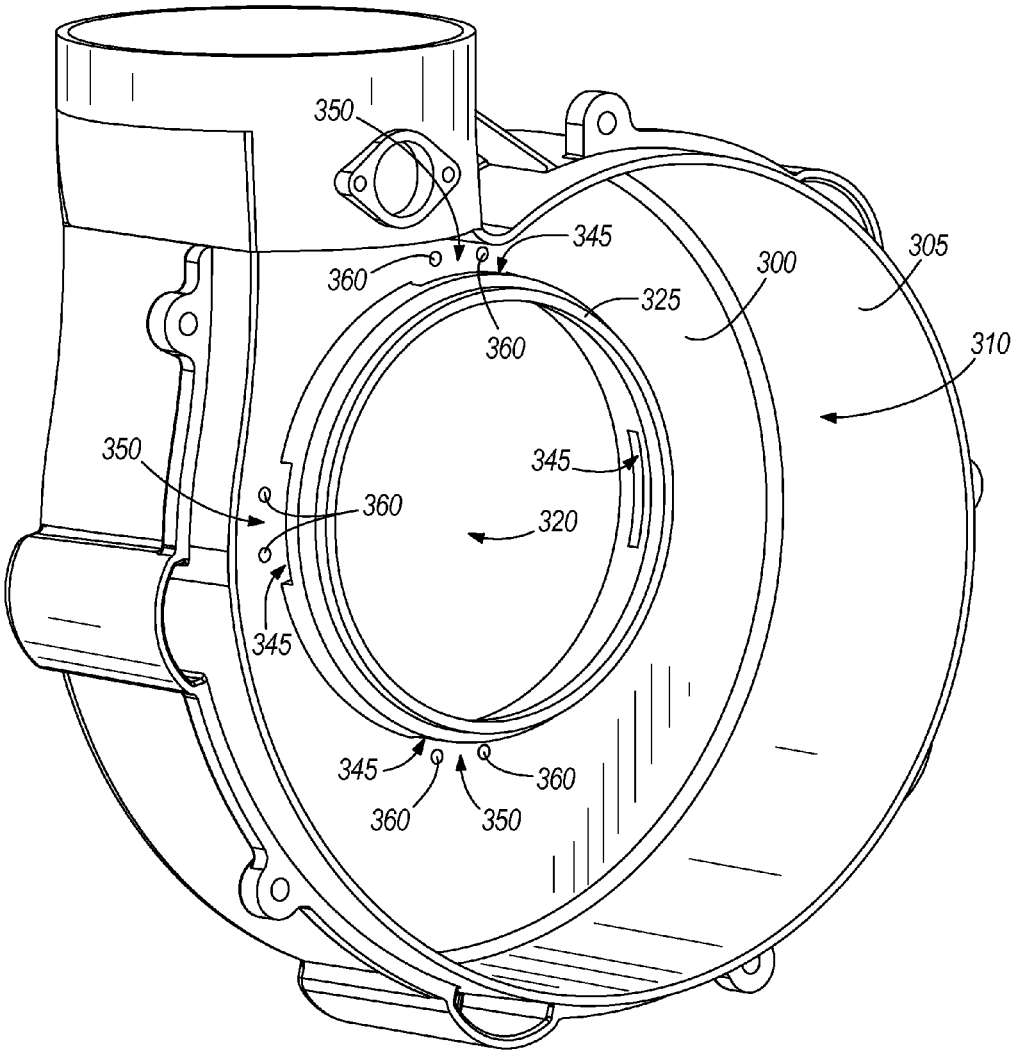
FIG. 7 is a rear perspective view of the blower housing of FIG. 6.

As shown in FIGS. 6 and 7, the blower housing 175 includes a front wall 300, an outer wall 305, an open rear portion 310, and an exhaust outlet 315. An opening 320 is formed through the front wall 300. A collar 325 surrounds the opening and extends rearwardly from the front wall 300. The collar 325 is cylindrical and coaxial with the opening 320. As best shown in FIG. 8, the collar 325 includes a stop 330 where the inner diameter of the collar 325 decreases from a wide portion 335 to a narrow portion 340. As shown in FIGS. 6 and 7, four slots or openings 345 extend through the collar 325. The slots 345 are positioned ninety degrees apart from one another about the center axis of the collar 325 and opening 320. Four tab mounting locations 350 are positioned radially outwardly of the slots 345 on the front wall 300. Each tab mounting location 350 includes a pair of bosses 355 and a pair of openings 360, each opening 360 extending through a boss 355 and the front wall 300. In some embodiments, the openings 360 are threaded. In other embodiments, a threaded insert is positioned in each opening 360. A housing mounting location 365 is positioned radially outwardly from one of the tab mounting locations 350 on the front wall 300. The housing mounting location 365 includes a pair of bosses 370 and a pair of openings 375, each opening extending into a boss 370. In some embodiments, the openings 375 are threaded. In other embodiments, each boss 370 includes a threaded insert positioned in the opening 375 extending into the boss 370.

The outer wall 305 is generally cylindrical and the exhaust outlet 315 extends tangentially from the outer wall 305. Exhaust gases exit the blower housing 175 through the opening 380 along an outlet axis 385. The exhaust outlet 315 faces in the direction of the exhaust gases exiting the blower housing 175 along the outlet axis 385.

Figure 9:
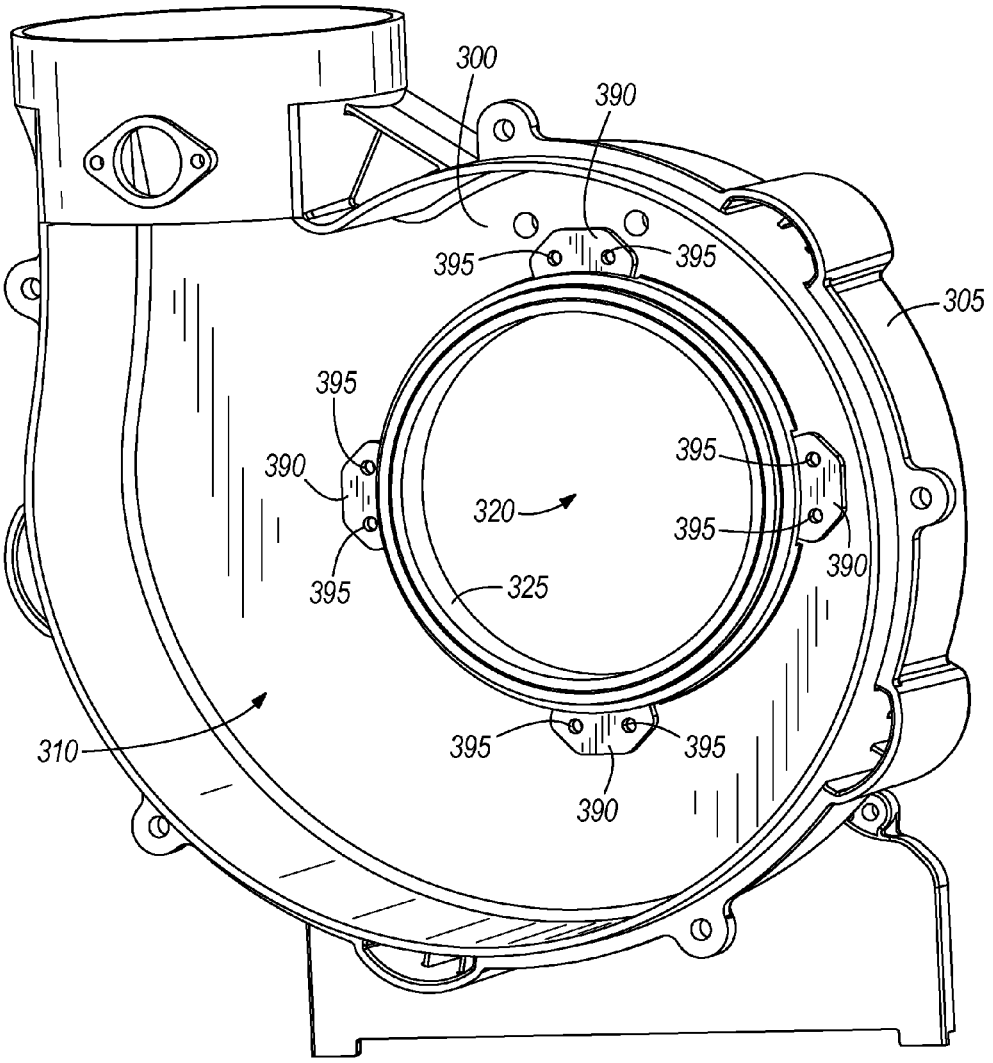
FIG. 9 is a rear perspective view of the blower housing of FIG. 6.

As shown in FIG. 8, the blower housing 175 is coupled to the back plate 172 so that the collar 325 receives the rim 260 and the collar 325 and the rim 260 are coaxial. The protrusion 265 abuts the stop 330 to limit the axial insertion of the rim 260 into the collar 325 and to align the slots 345 with the locking groove 280. A tab 390 is inserted through each of the slots 345 so that a lower portion of the tab 390 is positioned in the locking groove 280. As shown in FIG. 9, each tab 390 includes a pair of openings 395 that are aligned with the openings 360 of a tab mounting location 350 when the tab 390 is inserted into a slot 345. A fastener is inserted through each opening 395 and into a corresponding opening 360 to secure each tab 390 to the blower housing 175 at a tab mounting location 350. The fasteners can be, for example, a threaded bolt or a sheet-metal screw. After the tabs 390 are secured to the blower housing 175, the tabs 390 are free to slide within the locking groove 280 so that the blower housing 175 is rotatable about the center axis of the rim 260 and cannot be non-destructively uncoupled from the hood 170 without unsecuring the tabs from the blower housing 175.

Figure 10:
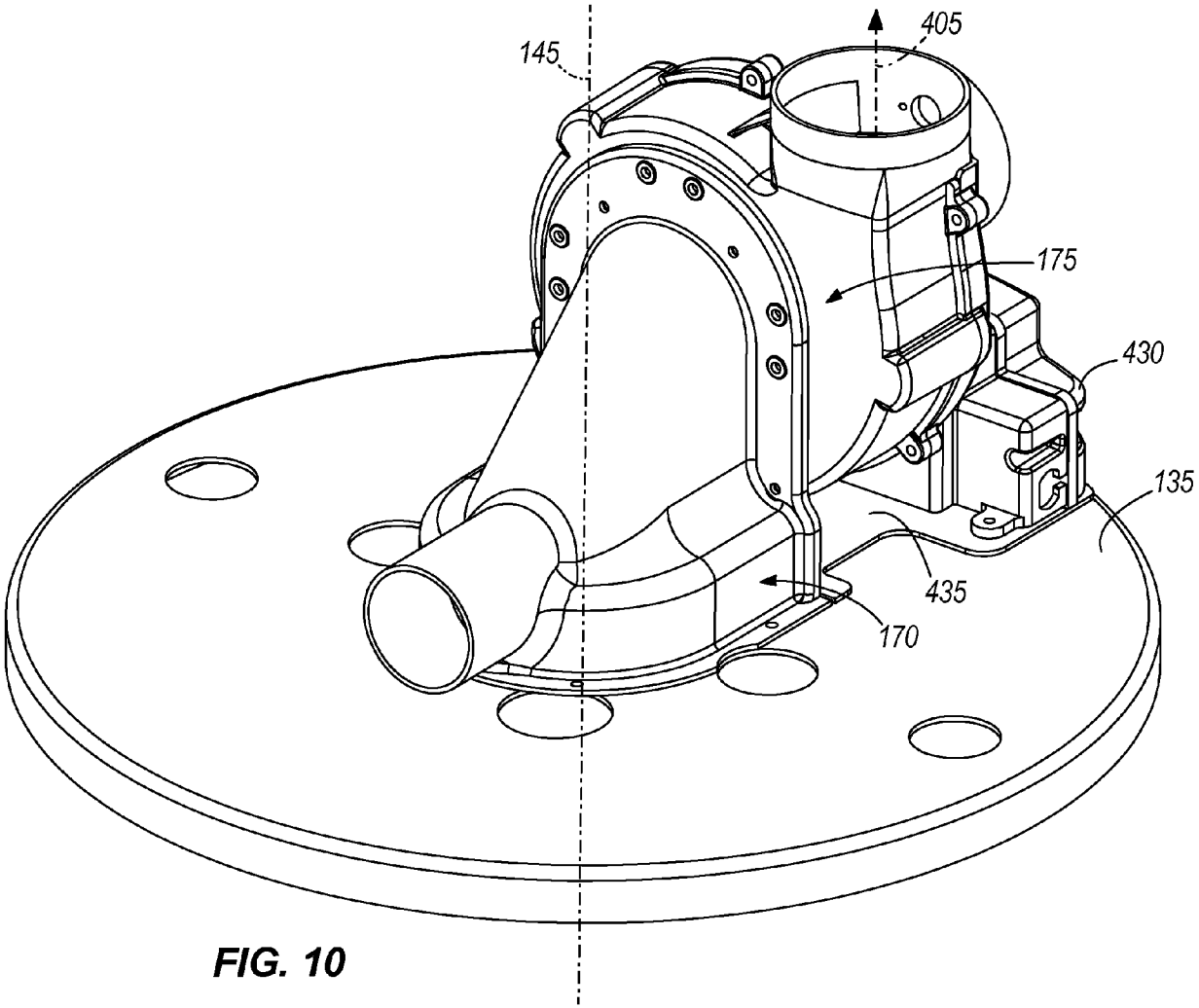
FIG. 10 is a perspective view of the exhaust assembly of FIG. 1 in a second configuration.
Figure 11:
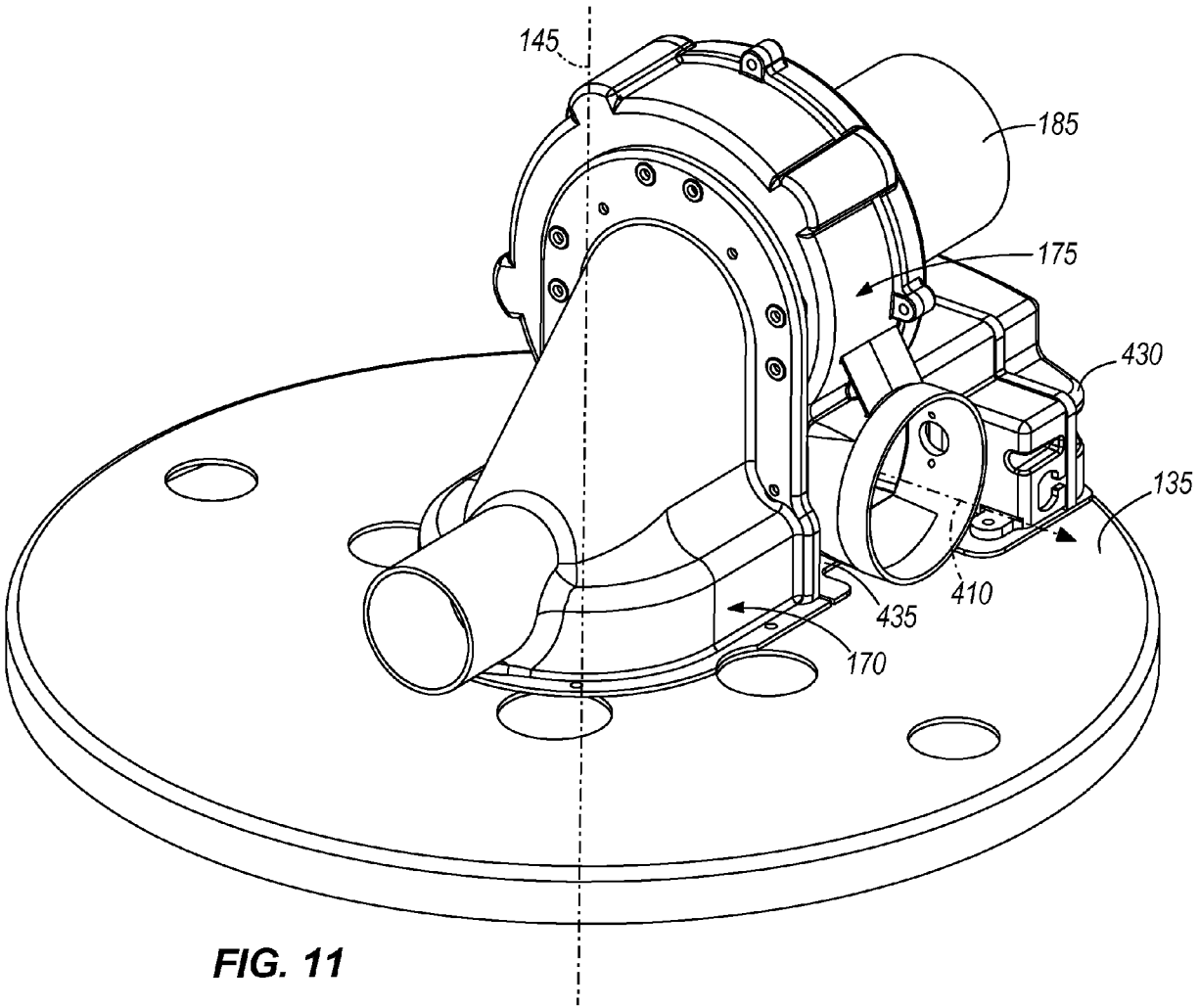
FIG. 11 is a perspective view of the exhaust assembly of FIG. 1 in a third configuration.

As shown in FIGS. 2, 10, and 11, the blower housing 175 can be secured in three positions relative to the hood 170. In a first configuration, the exhaust outlet 315 faces in a first direction 400 that is angled ninety degrees from the longitudinal axis 145 of the flue 140 and the housing mounting location 365 is aligned with the first hood mounting location 225. The housing mounting location 365 is secured at the first hood mounting location 225. In a second configuration, the exhaust outlet 315 faces in a second direction 405 that is angled ninety degrees from the first direction 400 (parallel to the longitudinal axis 145 of the flue 140) and the housing mounting location 365 is aligned with the second hood mounting location 230. The housing mounting location 365 is secured at the second hood mounting location 230. In a third configuration, the exhaust outlet 315 faces in a third direction 410 that is angled one hundred eighty degrees from the first direction 400 and the housing mounting location 365 is aligned with the third hood mounting location 235. The housing mounting location 365 is secured at the third hood mounting location 235. The blower housing 175 is rotated or pivoted about an axis perpendicular to the longitudinal axis 145. The directions 400, 405, and 410 are located in a plane that is parallel to the longitudinal axis 145. The housing mounting location 365 is secured to one of the hood mounting locations 225, 230, and 235 by inserting a fastener through each of the openings 240 and into a corresponding opening 375. The fasteners can be, for example, a threaded bolt or a sheet-metal screw. The exhaust assembly 165 allows the installer to rotate the blower housing 175 between the three configurations without having to partially disassemble the exhaust assembly 165. The tabs 390 ensure that the blower housing 175 remains coupled to the back plate 172 even when the housing mounting location 365 is not secured at a hood mounting location 225, 230, and 235. In some embodiments, the exhaust assembly 165 includes more or fewer configurations as described above. More configurations are added by increasing the number of hood mounting locations. Decreasing the number of hood mounting locations reduces the number of configurations.

As shown in FIG. 3, the fan 180 is positioned within the blower housing 175. A cover 415 is secured to the blower housing 175 to cover the open rear portion 310. The motor 185 is secured to the cover 415 by a motor mount 420. A motor shaft 425 extends from the motor 185 through the cover 415 and is connected to the fan 180. As the motor 185 shaft rotates, the fan 180 also rotates to move the exhaust gas from the hood 170 out of the exhaust outlet 315. A control unit 430 is mounted to a base plate 435 and electrically connected to the motor 185. The control unit 430 includes a power supply, a controller, and other components necessary to power and control the motor 185 and the exhaust assembly 165. The base plate 435 includes a back plate bracket 440 that is secured to the back plate 172 and positioned between the back plate 172 and the hood 170.

Figure 12:
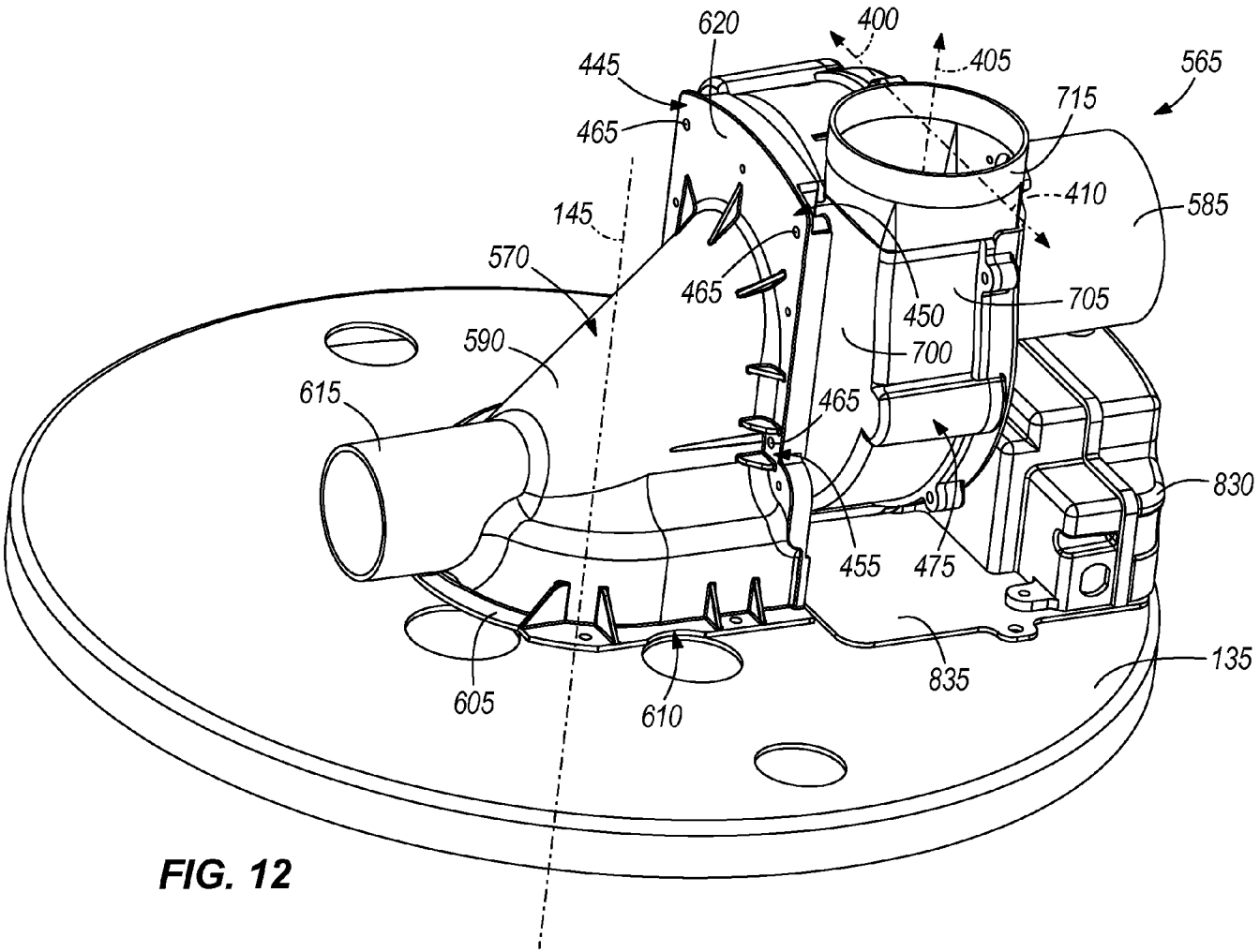
FIG. 12 is a perspective view of a second embodiment of an exhaust assembly.
Figure 13:
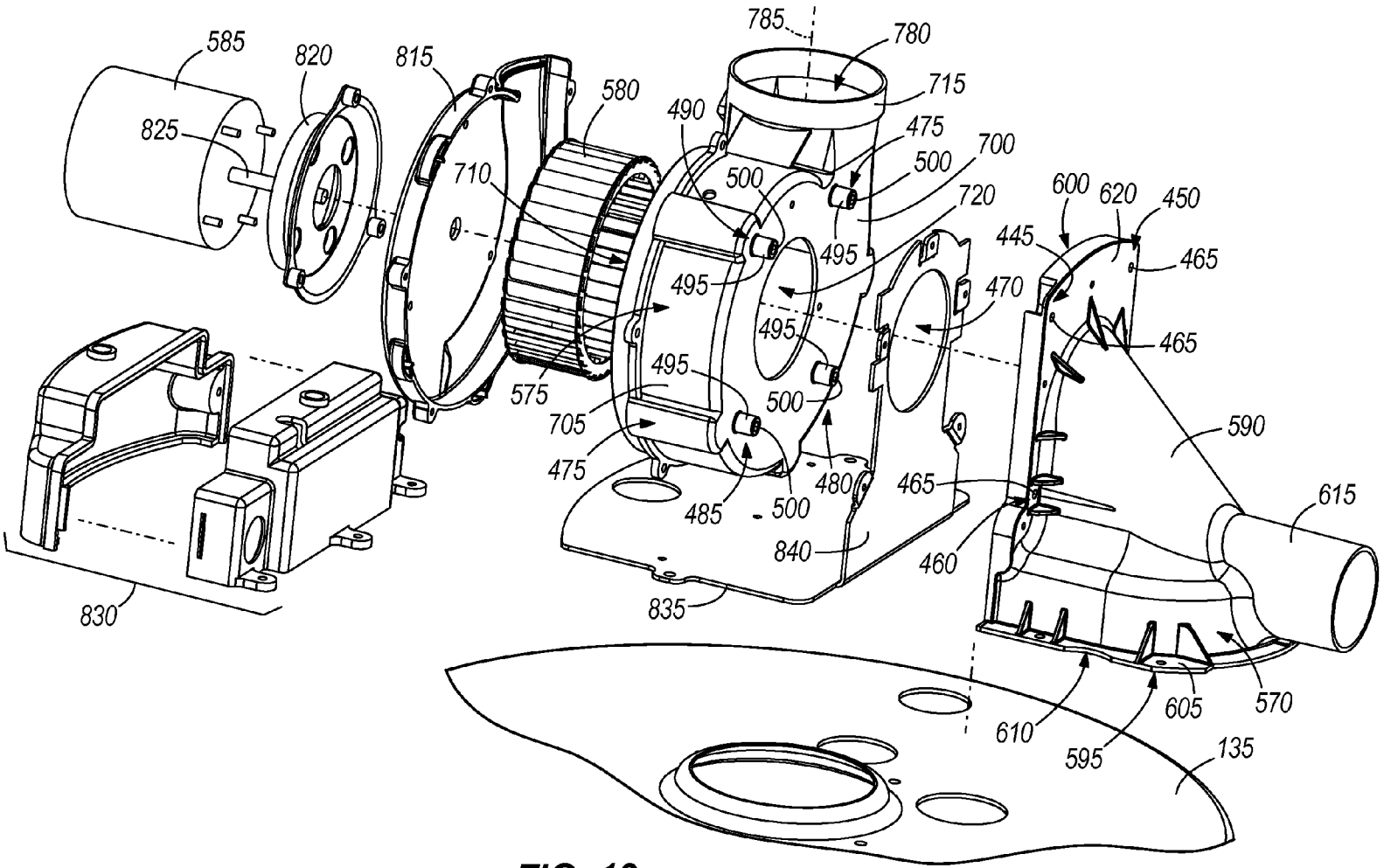
FIG. 13 is an exploded view of the exhaust assembly of FIG. 12.

FIGS. 12 and 13 illustrate an exhaust assembly 565 similar to the exhaust assembly 165. Components similar to those of exhaust assembly 165 described above are numbered in a similar fashion plus four hundred. Some of the differences between the exhaust assembly 565 and the exhaust assembly 165 are described below.

The hood 570 includes four hood mounting locations 445, 450, 455, and 460. Each of the hood mounting locations 445, 450, 455, and 460 includes an opening, aperture, or hole 465 through the housing mounting flange 620. Each of the four hood mounting locations 445, 450, 455, and 460 is positioned at a corner of a quadrilateral, for example, a square or rectangle. The exhaust assembly 565 does not include a back plate 172. Instead, the back plate bracket 840 of the base plate 835 is coupled to the hood 570 and partially covers the open rear portion 600. The back plate bracket 840 includes an opening 470. The blower housing 575 does not include a collar 725. The front wall 700 of the blower housing 575 includes four housing mounting locations 475, 480, 485, and 490. Each of the housing mounting locations 475, 480, 485, and 490 includes a boss 495 and an opening 500 extending into the boss 495. In some embodiments, the openings 500 are threaded. In other embodiments, a threaded insert is positioned in each opening 500 extending into a boss 495. Each of the four housing mounting locations 475, 480, 485, and 490 is positioned at a corner of a quadrilateral, for example, a square or rectangle. The size and shape of the quadrilateral formed by the four housing mounting location 475, 480, 485, and 490 is substantially identical to the size and shape of the quadrilateral formed by the four hood mounting locations 445, 450, 455, and 460.

The blower housing 575 is secured to the hood 570 by inserting a fastener through each of the openings 465 and into a corresponding opening 500. In a first configuration, the exhaust outlet 715 faces in the first direction 400 that is angled ninety degrees from the longitudinal axis 145 of the flue 140 and the first housing mounting location 475 is aligned with the first hood mounting location 445. In a second configuration, the exhaust outlet 715 faces in the second direction 405 that is angled ninety degrees from the first direction 400 (parallel to the longitudinal axis 145 of the flue 140) and the first housing mounting location 475 is aligned with the second hood mounting location 450. In a third configuration, the exhaust outlet 715 faces in the third direction 410 that is angled one hundred eighty degrees from the first direction 400 and the first housing mounting location 475 is aligned with the third hood mounting location 455. The opening 470 through the back plate bracket 840 is coaxial with the opening 720 through the front wall 700 of the blower housing 575 when the blower housing 575 is secured to the hood 570.

Figure 14:
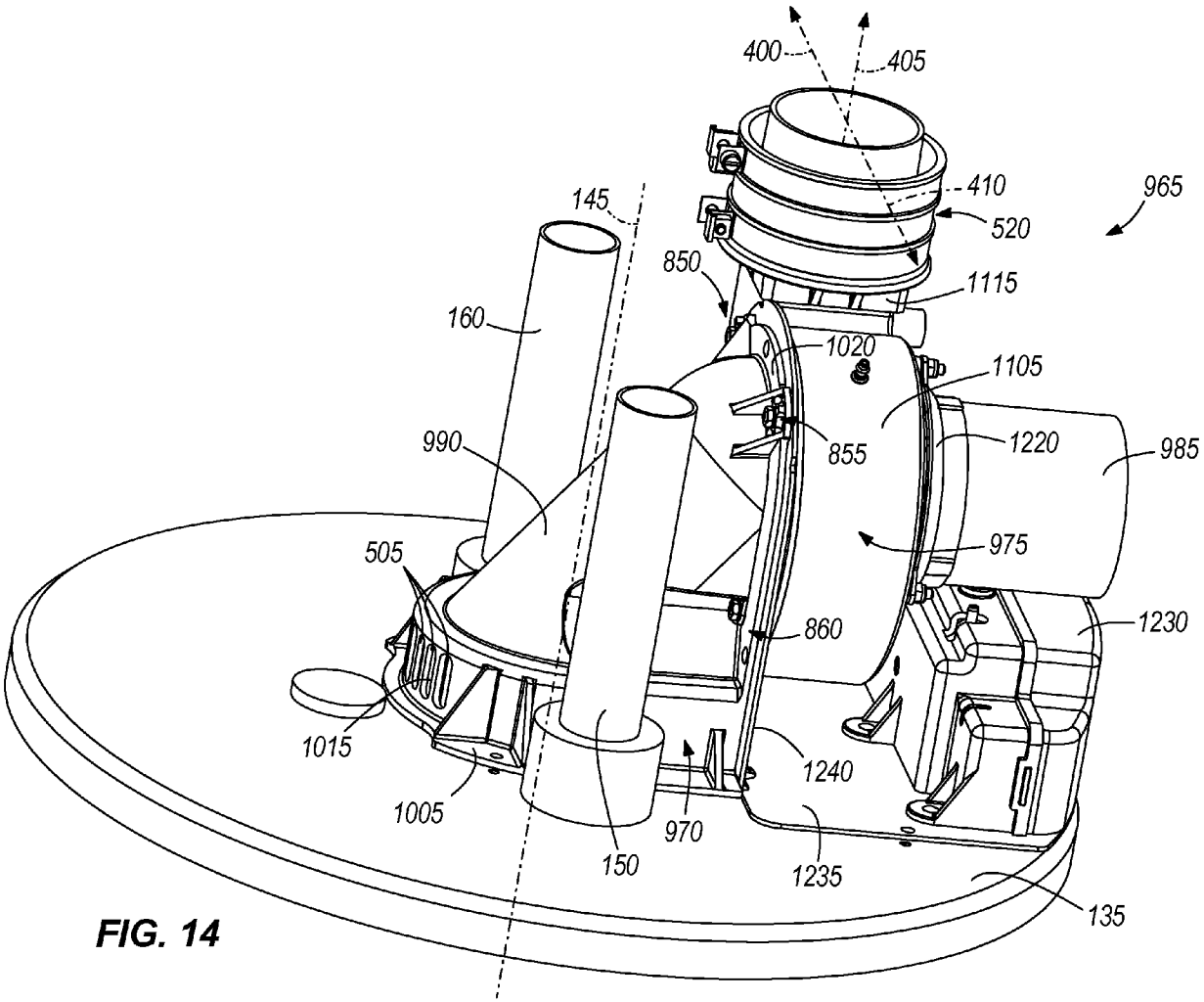
FIG. 14 is a perspective view of a third embodiment of an exhaust assembly.
Figure 15:
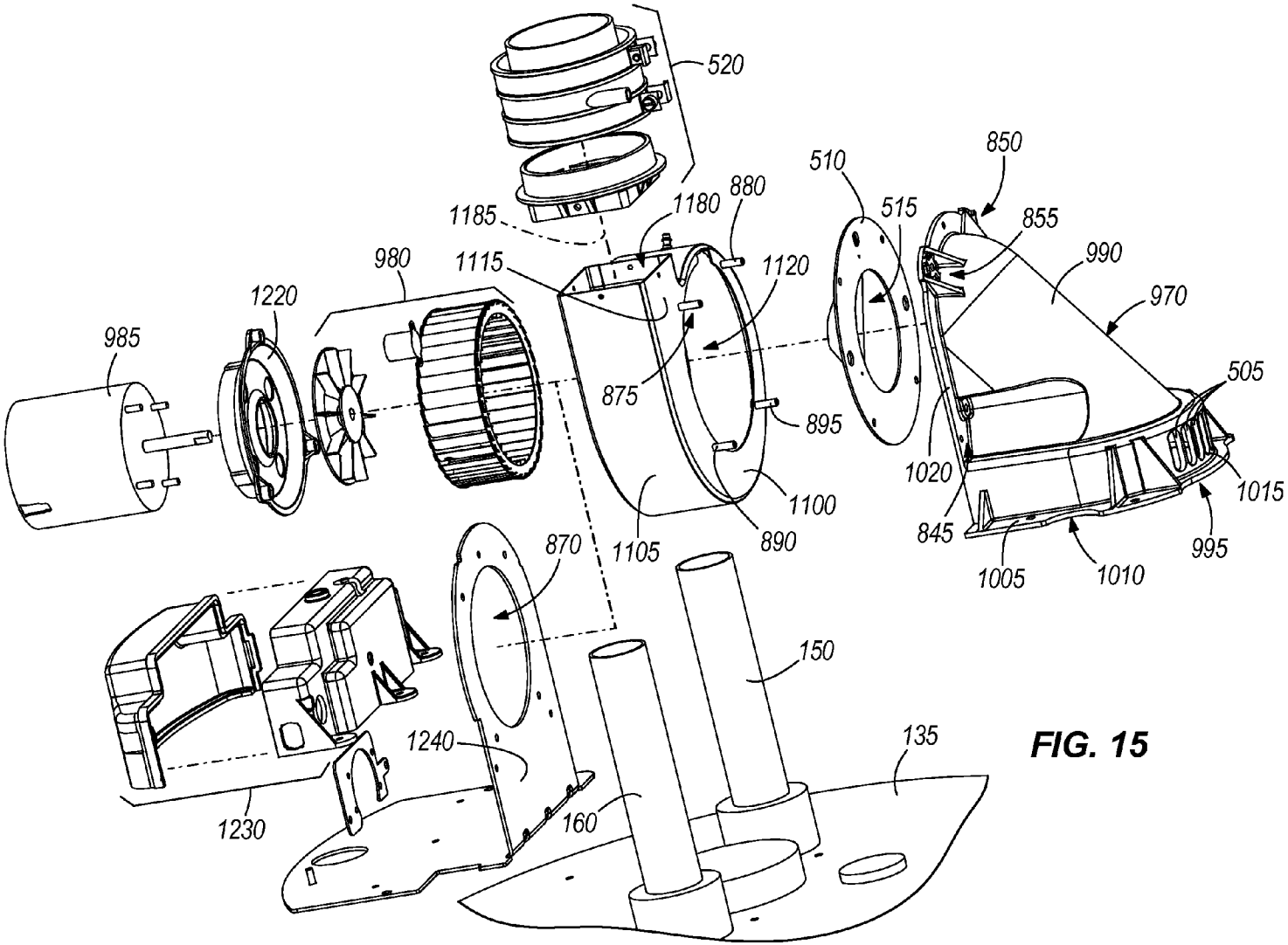
FIG. 15 is an exploded view of the exhaust assembly of FIG. 14.

FIGS. 14 and 15 illustrate an exhaust assembly 965 similar to the exhaust assembly 565. Components similar to those of exhaust assembly 565 described above are numbered in a similar fashion plus four hundred. Some of the differences between the exhaust assembly 965 and the exhaust assembly 565 are described below.

The air inlet 1015 is a grate formed by a series of slots or elongated openings 505 rather than a tube. A ring-shaped plate 510 is positioned between the blower housing 975 and the back plate bracket 1240. The plate 510 includes a central opening 515 that is smaller in diameter than the opening 870 through the back plate bracket 1240. Alternatively, the plate 510 is positioned between the hood 970 and the back plate bracket 1240. The motor mount 1220 secures the motor 985 to the blower housing 975 and also serves to cover the open rear portion 1110 of the blower housing 575. The opening 1180 in the exhaust outlet 1115 is square. A transition collar 520 connected to the exhaust outlet 1115 changes the cross section of the exhaust gas flow path from a square to a circle.

In a first configuration, the exhaust outlet 1115 faces in the first direction 400 that is angled ninety degrees from the longitudinal axis 145 of the flue 140 and the first housing mounting location 875 is aligned with the first hood mounting location 845. In a second configuration, the exhaust outlet 1115 faces in the second direction 405 that is angled ninety degrees from the first direction 400 (parallel to the longitudinal axis 145 of the flue 140) and the first housing mounting location 875 is aligned with the second hood mounting location 850. In a third configuration, the exhaust outlet 1115 faces in the third direction 410 that is angled one hundred eighty degrees from the first direction 400 and the first housing mounting location 875 is aligned with the third hood mounting location 855. The opening 515 through the plate 510, the opening 870 through the back plate bracket 1240, and the opening 1120 through the front wall 1100 of the blower housing 975 are all coaxial when the blower housing 975 is secured to the hood 970.

The three configurations of the exhaust assemblies 165, 565, and 965 allow an installer to configure an exhaust assembly 165, 565, and 965 to best meet the spacing limitations of the installation location of the water heater 100. Known exhaust assemblies only allow for an upward orientation of an exhaust outlet when the exhaust assembly is installed for use in the intended manner. This can complicate or limit the installation of an exhaust assembly if the installation location has a low clearance above the water heater, if the installation location is crowded with other appliances or ductwork, or if the installation location includes other obstacles. By allowing the exhaust outlet 315, 715, and 1115 to be oriented in three different directions 400, 405, and 410, each exhaust assembly 165, 565, 965 allows the installer to select the best configuration for use with a specific installation location. Once the installer has chosen one of the three configurations, the exhaust outlet 315, 715, and 1115 can be connected to an exhaust duct that connects the exhaust assembly 165, 565, and 965 to the atmosphere outside the building. Additionally, selecting the best configuration for use with a specific installation location can eliminate an elbow in the exhaust duct, thereby reducing the length of duct needed between the water heater and the outside of the building.

A hood mounting location is the location on the hood with which a housing location is aligned in a specific configuration of the exhaust assembly and to which the housing mounting location is secured. The hood mounting locations and housing mounting locations described above are illustrative of a variety of possible hood mounting location and housing mounting locations. In some embodiments, more or fewer openings are provided at each hood mounting location and housing mounting location. In other embodiments, a hood mounting location is a specific portion of the housing mounting flange and the housing mounting location is a specific portion of the front wall that are aligned and secured together by a fastener including, for example, a self-tapping fastener, an adhesive, a clip, or a clamp.

Various features of the invention are set forth in the following claims.

What is claimed is:

1. An exhaust assembly for use with a gas-fired water heater, the exhaust assembly comprising:

a hood for receiving exhaust gas from the gas-fired water heater, the hood including a first hood mounting location and a second hood mounting location;

a back plate coupled to the hood, the back plate including a rearwardly extending cylindrical rim with a locking groove formed in the outer surface of the rim, the cylindrical rim including a center axis;

a housing including an exhaust outlet, a housing mounting location, and a cylindrical collar with a plurality of slots through the collar, the rim positioned within the collar;

a plurality of tabs separate from the housing, hood, and backplate, each tab inserted through the slots in the collar and into the locking groove and fastened to the housing, thereby rotatably coupling the housing to the hood with the tabs free to slide within the locking groove so that the housing is rotatable about the center axis of the cylindrical rim; and a fan positioned in the housing to move exhaust gas from the hood out of the exhaust outlet;

wherein in a first configuration, the exhaust outlet faces a first direction and the housing mounting location is aligned with and secured at the first hood mounting location; and wherein in a second configuration, the exhaust outlet faces a second direction different than the first direction and the housing mounting location is aligned with and secured at the second hood mounting location.

2. The exhaust assembly of claim 1, further comprising:

a gasket positioned between the hood and the back plate to provide a substantially air-tight seal between the hood and the back plate.

3. The exhaust assembly of claim 1, further comprising:

a seal; and a seal groove formed in the outer surface of the rim, the seal positioned in the seal groove to provide a substantially air-tight seal between the hood and the housing.

4. The exhaust assembly of claim 1, wherein the first direction is angled ninety degrees from the second direction.

5. The exhaust assembly of claim 1, wherein the hood further includes a third hood mounting location; and wherein in a third configuration, the exhaust outlet faces a third direction different than the first direction and the second direction and the housing mounting location is aligned with and secured at the third hood mounting location.

6. The exhaust assembly of claim 5, wherein the first direction is angled ninety degrees from the second direction; and wherein the first direction is angled one hundred eighty degrees from the third direction.

7. The exhaust assembly of claim 2, wherein the hood further includes a third hood mounting location;

wherein in a third configuration, the exhaust outlet faces a third direction different than the first direction and the second direction and the housing mounting location is aligned with and secured at the third hood mounting location; and wherein the first direction is angled ninety degrees from the second direction and the first direction is angled one hundred eighty degrees from the third direction.

8. The exhaust assembly of claim 3, wherein the hood further includes a third hood mounting location;

wherein in a third configuration, the exhaust outlet faces a third direction different than the first direction and the second direction and the housing mounting location is aligned with and secured at the third hood mounting location; and wherein the first direction is angled ninety degrees from the second direction and the first direction is angled one hundred eighty degrees from the third direction.

9. The exhaust assembly of claim 2, further comprising:

a seal; and a seal groove formed in the outer surface of the rim, the seal positioned in the seal groove to provide a substantially air-tight seal between the hood and the housing.

10. The exhaust assembly of claim 9, wherein first direction is angled ninety degrees from the second direction.

11. The exhaust assembly of claim 9, wherein the hood further includes a third hood mounting location; and wherein in a third configuration, the exhaust outlet faces a third direction different than the first direction and the second direction and the housing mounting location is aligned with and secured at the third hood mounting location.

12. The exhaust assembly of claim 11, wherein the first direction is angled ninety degrees from the second direction and the first direction is angled one hundred eighty degrees from the third direction.

* * * * *